US009156268B2

(12) United States Patent
Carlson et al.

(10) Patent No.: US 9,156,268 B2
(45) Date of Patent: Oct. 13, 2015

(54) OPERATING MECHANISM FOR AN INKJET PRINTER

(71) Applicant: Marvell World Trade Ltd, St. Michael (BB)

(72) Inventors: Gregory F Carlson, Corvallis, OR (US); Steven Goss, Corvallis, OR (US)

(73) Assignee: Marvell World Trade Ltd., St. Michael (BB)

( * ) Notice: Subject to any disclaimer, the term of this patent is extended or adjusted under 35 U.S.C. 154(b) by 101 days.

(21) Appl. No.: 13/686,609

(22) Filed: Nov. 27, 2012

(65) Prior Publication Data

US 2013/0083122 A1 Apr. 4, 2013

Related U.S. Application Data

(63) Continuation of application No. 12/098,923, filed on Apr. 7, 2008, now Pat. No. 8,322,817.

(60) Provisional application No. 60/910,314, filed on Apr. 5, 2007.

(51) Int. Cl.
*B41J 2/165* (2006.01)

(52) U.S. Cl.
CPC ..... *B41J 2/1652* (2013.01); *B41J 2/16547* (2013.01); *B41J 2/16585* (2013.01)

(58) Field of Classification Search
None
See application file for complete search history.

(56) References Cited

U.S. PATENT DOCUMENTS

| | | | | |
|---|---|---|---|---|
| 4,872,026 | A | 10/1989 | Rasmussen et al. | |
| 4,935,753 | A | 6/1990 | Lehmann et al. | |
| 5,097,276 | A | 3/1992 | Midorikawa | |
| 5,103,244 | A | 4/1992 | Gast et al. | |
| 5,160,945 | A | 11/1992 | Drake | |
| 5,489,160 | A | 2/1996 | Patrick et al. | |
| 5,500,660 | A | 3/1996 | Childers et al. | |
| 5,548,309 | A | 8/1996 | Okubo et al. | |
| 5,663,751 | A | 9/1997 | Holbrook | |
| 5,672,017 | A | 9/1997 | Taniguchi | |
| 5,774,139 | A | 6/1998 | Salzer et al. | |
| 6,030,069 | A | 2/2000 | Wakahara et al. | |
| 6,198,492 | B1 * | 3/2001 | Wakahara et al. | 347/141 |
| 6,536,866 | B1 | 3/2003 | Uchikata | |

(Continued)

FOREIGN PATENT DOCUMENTS

| | | | |
|---|---|---|---|
| CN | 1907714 | A | 2/2007 |
| EP | 1 208 993 | A1 | 5/2002 |

(Continued)

OTHER PUBLICATIONS

Berg, Richard H., "Reverse Shaft Mechanism," Xerox Disclosure Journal published by Xerox, vol. 25, No. 2, Mar./Apr. 2001, p. 69.

(Continued)

*Primary Examiner* — Alejandro Valencia

(57) ABSTRACT

A printer system includes a print head assembly that ejects a printing solution from a fixed position during a print period and a conveying mechanism operable to convey an operations assembly. The operations assembly executes servicing functions on the print head assembly during a non-print period. Furthermore, the print head assembly remains in the fixed position during the non-print period and the operations assembly provides support for a print medium during the print period.

21 Claims, 4 Drawing Sheets

(56) References Cited

U.S. PATENT DOCUMENTS

| | | | | |
|---|---|---|---|---|
| 6,561,618 | B1 | 5/2003 | Simmons et al. | |
| 6,851,787 | B2 * | 2/2005 | Johnson | 347/22 |
| 2004/0155921 | A1 * | 8/2004 | Simmons et al. | 347/33 |
| 2004/0246324 | A1 | 12/2004 | Nakashima | |
| 2005/0078145 | A1 * | 4/2005 | Inoue | 347/31 |
| 2006/0061619 | A1 | 3/2006 | Gast et al. | |
| 2006/0170728 | A1 | 8/2006 | Simmons et al. | |
| 2007/0030303 | A1 | 2/2007 | Ha et al. | |

FOREIGN PATENT DOCUMENTS

| | | | |
|---|---|---|---|
| JP | 03-234623 | A | 10/1991 |
| JP | 06-023999 | A | 2/1994 |
| JP | 09-070961 | | 3/1997 |
| JP | 9-123470 | A | 5/1997 |
| JP | 2000 198210 | A | 7/2000 |
| JP | 2000-343716 | | 12/2000 |
| JP | 2001-293874 | | 10/2001 |
| JP | 2002-321378 | | 11/2002 |
| JP | 2002-356026 | | 12/2002 |
| JP | 2003-011377 | | 1/2003 |
| JP | 2003-170612 | | 6/2003 |

OTHER PUBLICATIONS

Patent Cooperation Treaty From the International Searching Authority; Notification of Transmittal of the International Search Report and the Written Opinion of the International Searching Authority, or the Declaration; Aug. 7, 2008; International Filing Date: Jul. 4, 2008; International Application No. PCT/US 08/59559; 7 pgs.

Office Action from the State Intellectual Property Office of the People's Republic of China, dated Sep. 3, 2010, Application No. 200880019037.1.

Office Action from the State Intellectual Property Office of the People's Republic of China dated Apr. 12, 2012, Application No. 200880019037.1.

Office Action issued in corresponding Japanese Appln. No. 2010-502347 dated Jun. 12, 2012 (2 pgs).

U.S. Appl. No. 09/948,343, filed Sep. 5, 2001, Simmons et al.

U.S. Appl. No. 11/391,095, filed Mar. 27, 2006, Simmons et al.

Office Action from the State Intellectual Property Office of the People's Republic of China dated Dec. 4, 2012, Application No. 200880019037.1, 1 pg.

* cited by examiner

OPERATING MECHANISM FOR AN INKJET PRINTER

RELATED APPLICATION

This patent application is a continuation of U.S. patent application Ser. No. 12/098,923 (now U.S. Pat. No. 8,322,817), filed on Apr. 7, 2008, which claims the benefit of U.S. Provisional Application No. 60/910,314, filed on Apr. 5, 2007. Both U.S. patent application Ser. No. 12/098,923 and U.S. Provisional Application No. 60/910,314 are incorporated by reference herein in their entirety.

BACKGROUND

1. Technical Field

The present disclosure relates generally to inkjet printers and, more particularly, to servicing mechanisms for inkjet printers.

2. Related Art

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Typical, small inkjet printers for home and/or office use include a print head provided with liquid ink from an ink supply. During operation, the print head ejects ink drops through a plurality of orifices or nozzles toward a print medium (e.g. a sheet of paper) thereby providing a printing pattern on the print medium. The orifices are generally configured in one or more arrays so that properly sequenced ejection of ink from the orifices causes characters or other images to be printed on the print medium as the print head and the print medium are moved relative to each other.

In addition to the small inkjet printers that include selectively positioned print heads as described above, another style of printers known as page-wide printers are also in demand. Page-wide printers are constructed with a page-wide print head that includes page wide print arrays allowing for the entire width of the desired image to be printed without requiring movement of the page-wide print head. In other words, the page-wide print arrays span the entire width of the target print medium. Page-wide print heads thus require substantially more nozzles than commonly used inkjet printers.

An issue among inkjet printers involves the improper operation of one or more nozzles of the print head due to particulate accumulation and/or residual ink. Often various forms of debris can accumulate around the nozzles thereby causing interference (e.g., altered ink drop formation) with the normal nozzle operation. Additionally, the liquid ink can dry-out within and in the vicinity of the nozzles, thereby potentially causing the nozzles to be "plugged" (i.e., normal ink flow to be blocked). In the case of page-wide printers that may include thousands of nozzles, performance and efficiency can be substantially decreased due to improper nozzle operation.

BRIEF SUMMARY

The present invention is defined by the following claims, and nothing in this section should be taken as a limitation on those claims.

By way of introduction, the preferred embodiments below provide a printer system that includes a print head assembly that ejects a printing solution from a fixed position during a print period and a conveying mechanism operable to convey an operations assembly along a path. The operations assembly executes servicing functions on the print head assembly during a non-print period. Furthermore, the print head assembly remains in the fixed position during the non-print period and the operations assembly provides support for a print medium during the print period.

In other embodiments, the printer system includes print means for ejecting a printing solution from a fixed position during a print period and conveying means for conveying operating means along a path, where the operating means executes servicing functions on the print means during a non-print period. Furthermore, the print means remains in the fixed position during the non-print period and the operating means provides support for a print medium during the print period.

In other features, the conveying means may include a drive belt. The conveying means may also include a rotating element. The print means includes a page-wide print head. The conveying means is operable to convey the operating means in one of a first direction and a second direction, where the second direction is opposite of the first direction.

In other features, the operating means includes a wiper, a capping element, and a support element. The wiper, the capping element, and the support element are mounted on the conveying means. The conveying means positions the capping element to engage the print means. The conveying means positions the wicker element substantially adjacent to the print means. The conveying means positions the wiper to engage the print means.

In other features, the system further comprises driving means for rotating the conveying means based on instructions from a control module. The control module one of stores the instructions in memory or receives the instructions from an external source.

Other systems, methods, and features of the invention will be, or will become, apparent to one with skill in the art upon examination of the following figures and detailed description. It is intended that all such additional systems, methods, features and advantages be included within this description, be within the scope of the invention, and be protected by the following claims.

The preferred embodiments will now be described with reference to the attached drawings.

DETAILED DESCRIPTION OF THE PRESENTLY PREFERRED EMBODIMENTS

The disclosure can be better understood with reference to the following drawings and description. The components in the figures are not necessarily to scale, emphasis instead being placed upon illustrating the principles of the invention.

Moreover, in the figures, like referenced numerals designate corresponding parts or elements throughout the different views. The following description is merely exemplary in nature and is in no way intended to limit the disclosure, its application, or uses. As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality. As used herein, the phrase at least one of A, B, and C should be construed to mean a logical (A or B or C), using a non-exclusive logical or. It should be understood that steps within a method may be executed in different order without altering the principles of the present disclosure.

By way of introduction, the embodiments described herein are related to printing systems such as inkjet printers that employ service stations or assemblies for maintaining proper operation of print heads and are merely exemplary in nature. The present disclosure describes an operational system that enables a print head to be serviced without requiring the print head to be driven outside the print zone, thereby enhancing the maintenance routine as well as minimizing the print system's size and effective cost.

Figure 1:
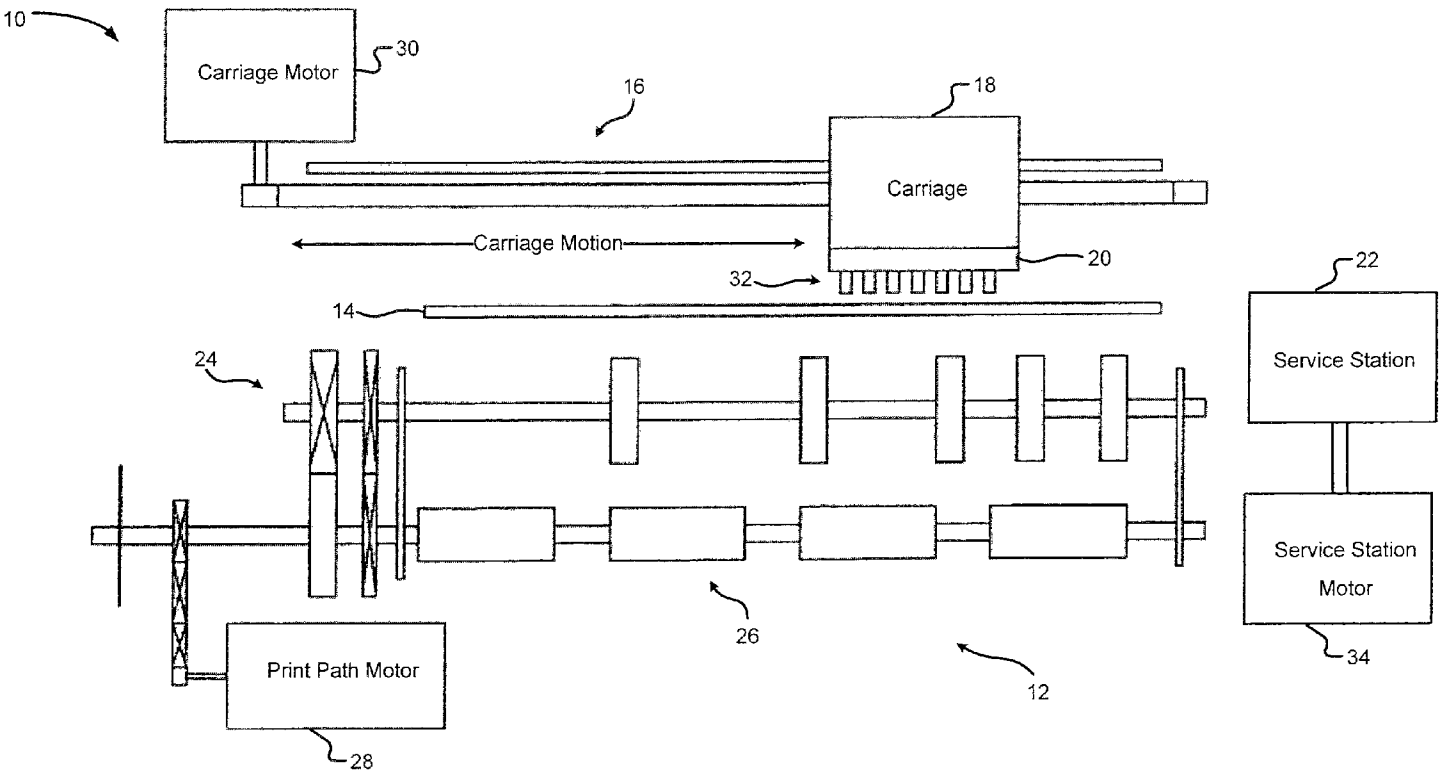
FIG. 1 (PRIOR ART)
FIG. 1 is a functional block diagram of an exemplary printing system according to the prior art.

Referring now to FIG. 1, an exemplary printing system 10 (e.g., an inkjet printing system) that implements a print system according to the prior art is shown. The printing system 10 includes a print media transport assembly 12 which moves and/or routes a print medium 14 move through a print media path, a carriage assembly 16 which moves a carriage 18 that transports a print head 20 relative to the print medium 14, and a service station assembly 22 which maintains functionality of the print head 20. In various embodiments (e.g., multi-function inkjet printing systems), the printing system 10 may include additionally assemblies such as a scanning/fax assembly.

The print media transport assembly 12 includes a print medium introduction assembly 24 that introduces the print medium 14 into the print system, a drive or feed roller assembly 26 which advances the print medium 14 through the print system, and a print path motor 28 which operates the print medium introduction assembly 24 and the feed roller assembly 26.

The carriage assembly 16 typically includes a carriage 18 that carries the print head 20 and a carriage motor 30 that operates the carriage. The print head 20 holds the nozzles 32 relative to the print medium 14. The service station assembly 22 typically includes a service station motor 34 which operates functions (i.e., service functions) of the service station assembly 22 discussed in more detail below.

A problem common among conventional inkjet printers involves the improper operation of one or more nozzles of a print head due to ink drying on the nozzles. Additionally, particles of debris may accumulate around the nozzles which interfere with proper nozzle operation. Therefore most conventional inkjet printers utilize a service station assembly, as depicted in FIG. 1, to perform maintenance or servicing functions including, but not limited to, removal and replacement of "nozzle caps", wiping the nozzles, and/or "spitting" of ink through nozzles to ensure proper operation of the print head. Caps (e.g., rubber elements) are used to cover the nozzles while not in use in order to prevent the ink from drying within or in the vicinity of the nozzles. Periodic wiping of the nozzle surfaces with a wiping element such as one or more rubber blades ("wipers") serves to remove excess ink from the nozzles. Similarly, periodic firing ("spitting") of ink through the nozzles is performed prior to depositing ink on a surface of a print medium in order to clean out (i.e., unblock) the nozzles in an effort to ensure normal ink flow.

Referring back to FIG. 1, the printing system 10, like most conventional inkjet printers, includes the carriage motor 30 to translate the carriage 18 in a perpendicular direction relative the direction of advancement of the print medium 14. As such, the carriage 18 (i.e., the print head 20) can be transitioned beyond the edges of the print medium 14 that define a print zone (i.e., an area in which ink is deposited to form a desired image) of the print medium 14. In the present embodiment, the carriage motor 30 may further drive the carriage 18 to be positioned over the service station assembly 22, past a border of the print medium 14, in order for the print head 20 to be serviced.

The service station assembly 22 includes a capping system (not shown) that, as discussed above, operates to cover the nozzles 32 while the nozzles 32 are not in use (i.e., during non-print periods). Additionally, while the print head 20 is positioned above the service station assembly 22, the print head executes the spitting process. In various embodiments, the spitting process may include firing a variable number of ink droplets through each respective nozzle of nozzles 32. The fired ink is collected by a reservoir portion or receptacle (not shown), such as a spittoon, of the service station assembly 22. In various embodiments, additional receptacles may be positioned beneath the print medium 14 to collect ink overspray generated during borderless, or edge-to-edge, printing known as "full bleed" printing. The service station assembly 22 further includes one or more wipers (not shown) to wipes the nozzles 32 of the print head 20 in order to remove ink residue as well as any debris that has accumulated on the nozzles 32.

Upon initiation of a print job (i.e., a printing operation), the carriage 18 is driven back over the print zone of the print medium 14. The print head 20 passes back and forth (i.e., traverses) across the print zone along a direction of motion, referred to as "carriage motion" in FIG. 1, while the nozzles 32 eject ink to form a desired image on the print medium 14. Upon completion of a print operation, the carriage 18 is driven towards the service station assembly 22 for servicing.

Servicing operations for other styles of inkjets printers (e.g., page-wide printers) operate in similar fashion. Page-wide printers utilize a page-wide print head that includes page-wide array(s) of nozzles that span the entire width of the print medium. In other words, an entire width of a desired image can be printed without requiring the page-wide print head to traverse a print zone of a print medium as noted above. As a result, page-wide print heads require an increased number (e.g., thousands) of nozzles relative to the number employed by typical inkjet printers (e.g., home office printers). Although a page-wide print head does not need to be driven back and forth across the print zone during print operations, periods of non-use still necessitate that the page-wide print head be moved beyond the borders of the target print medium in order to be serviced by a service station assembly as described above. As a result, page-wide printers are substantially large in size and complex and tend to be significantly more expensive.

Figure 2:
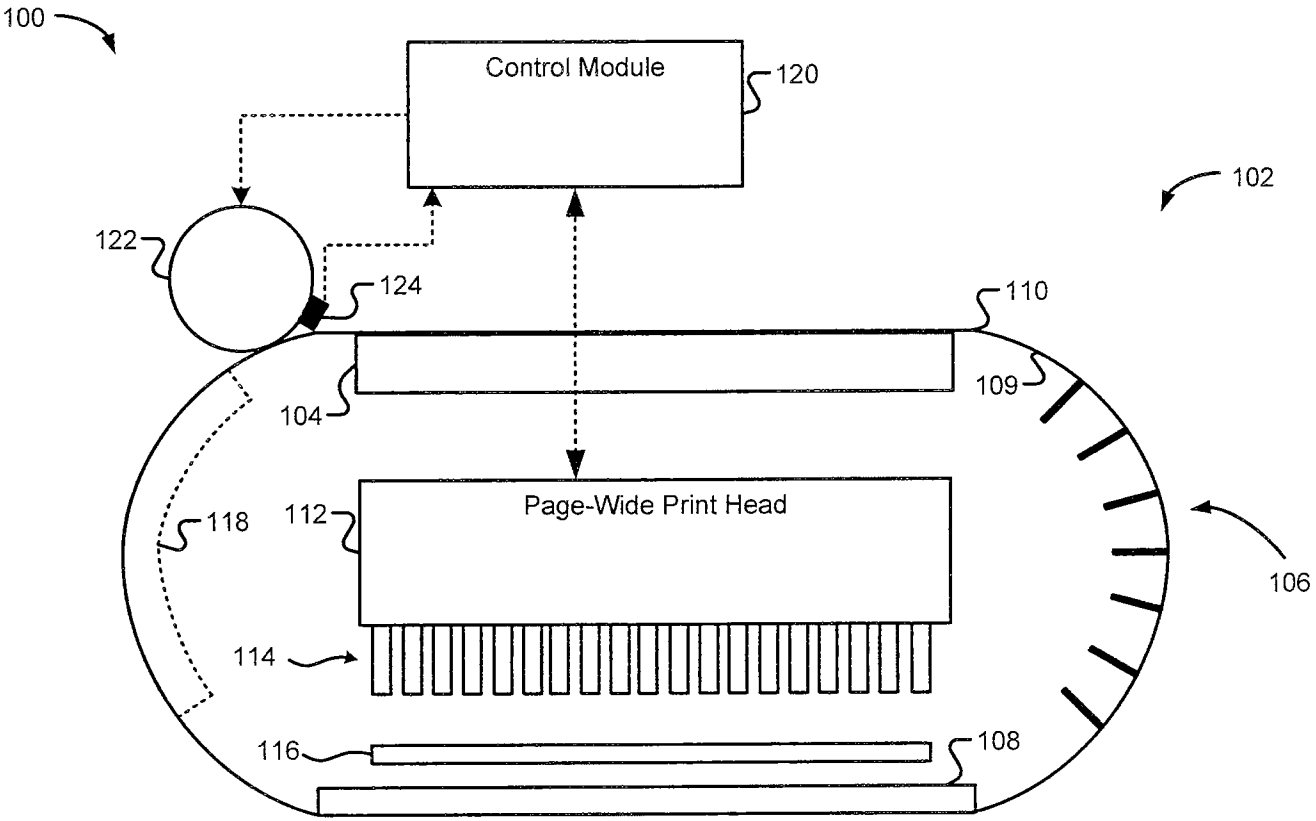
FIG. 2 is a functional block diagram of a first embodiment of an exemplary printing system according to the to the present disclosure.

Referring now to FIG. 2, a simplified front view of a first embodiment of a printer system 100 is shown. In the present implementation, the printer system 100 includes a page-wide inkjet print system, though the present disclosure anticipates various other embodiments of inkjet printers. The printer system 100 may implement an operational system of the present disclosure.

The printer system 100 includes an operations assembly 102, or assembly 102, having a capping element 104, wipers 106, and a support element 108, referred to collectively as the assembly elements. The assembly elements are respectively mounted on an inner surface 109 of a conveying mechanism (e.g., a drive belt 110) such that movement of the drive belt 110 along a rotational path translates to movement of the assembly elements along the same rotational path. For the sake of simplicity and brevity, the present disclosure will discuss the elements and operation of the assembly 102, though those skilled in the art will appreciate that the exemplary printer system 100 may include additional elements including, but not limited to, print media handling and movement assemblies, support and guidance assemblies, drive motors, and other functional modules such as detection and/or sensing modules. Furthermore, it is anticipated that the printer system 100 may include other assembly elements driven by the drive belt 110 and that the arrangement and/or spacing of the respective assembly elements about the drive belt 110 may be varied.

The printer system 100 includes one or more print heads 112 which eject a printing solution (e.g. ink) through a plurality of orifices or nozzles 114 in the direction of a print medium 116 in order to generate a desired image on the print medium 116. In the present embodiment, the print head 112 includes a page-wide print head. The nozzles 114 are arranged in one or more columns or arrays (e.g., page-wide print arrays) and may include a variable number of nozzles. The print medium 116 may include, but is not limited to, any suitable sheet material such as paper, card stock, transparencies, Mylar, or cloth.

The capping element 104 functions to cover the nozzles 114 while the nozzles are not in use (i.e., during non-print periods). The capping element 104 may include a pliable, latex based plastic though other materials are contemplated. The wipers 106 operate to wipe the nozzles 114 of the print head 112 to remove ink residue (e.g., ink that has hardened in or in the vicinity of the nozzles 114) as well as any particulate matter that has accumulated on the nozzles 114 that may block the passageways (not shown) of the nozzles 114. The wipers 106 typically sweep across the nozzles 114 during non-print periods and/or during transitional periods between print periods and non-print periods. The wipers 106 may include a variable number of wipers and may be comprised of rubber.

The support element 108 engages or supports the print medium 116 such that print medium 116 is positioned substantially adjacent to the print head 112. In the present embodiment, the support element 108 is arranged in close proximity to the print head 112 although other arrangements are anticipated. The support element 108 includes structures such as ribs or teeth to position the print medium 116. In the present embodiment, the support element 108 further includes a wicking material (e.g. a high density foam-like material) to absorb ink overspray resulting from full bleed printing on the print medium 116 as well as to collect excess ink fired from the nozzles 114 during spitting operations. In other words, at least one assembly element operates in conjunction with the print head 112 during both print and non-print operations of the printer system 100.

In other embodiments, the printer system 100 may include additional components mounted to the drive belt 110 such as an additional wicking element 118 shown in phantom. The wicking element 118 may be utilized during spitting operations.

As mentioned above, during operation, movement of the drive belt 110 translates to movement of the assembly elements. In the present embodiment, a drive wheel 122 (i.e., a driving element such as a motor) rotates the drive belt 110 in either a clockwise or counter-clockwise direction along a rotational path based on an activation signal generated by a control module 120. Those skilled in the art will appreciate that other elements such as pulleys or rollers, though not depicted, may operate in cooperation with the drive wheel 122 to impart movement to the drive belt 110.

The control module 120 communicates with a position encoder 124 (e.g., an optical detector) and the drive wheel 122. The position encoder 124 determines a respective position of the of drive belt 110 (i.e., determines the distance the drive belt 110 has advanced during operation) and generates a position signal indicating the position of the drive belt 110. During operation, the control module 120 activates the drive wheel 122 based on the position signal (i.e., position information) received from the position encoder 124. In other words, the control module 120 advances the drive belt 110 by utilizing the position signal in order to align the respective assembly elements relative to the print head 112 during various functions while the print head 112 remains in a fixed position. Additionally, the control module 120 may vary the rate at which the drive belt 110 advances around its rotational path.

The control module 120 may additionally control other elements of the printer system 100 based on the position signal. For example, the control module 120 may command the print head 112 to eject ink from the nozzles 114 at a given position based on a determined position of the drive belt 110.

The control module 120 may further control advancement of the drive belt 110 based on predetermined servicing instructions stored in memory. The servicing instructions may indicate the sequence, frequency, and/or duration of each respective servicing function (e.g., capping, spitting, and/or wiping) performed by the assembly elements. Additionally, the printer system 100 (i.e., the control module 120) may receive instructions from an external source (e.g., a user of the printer system 100) to execute various servicing functions, thereby actuating the drive belt 110 accordingly.

Figure 3:
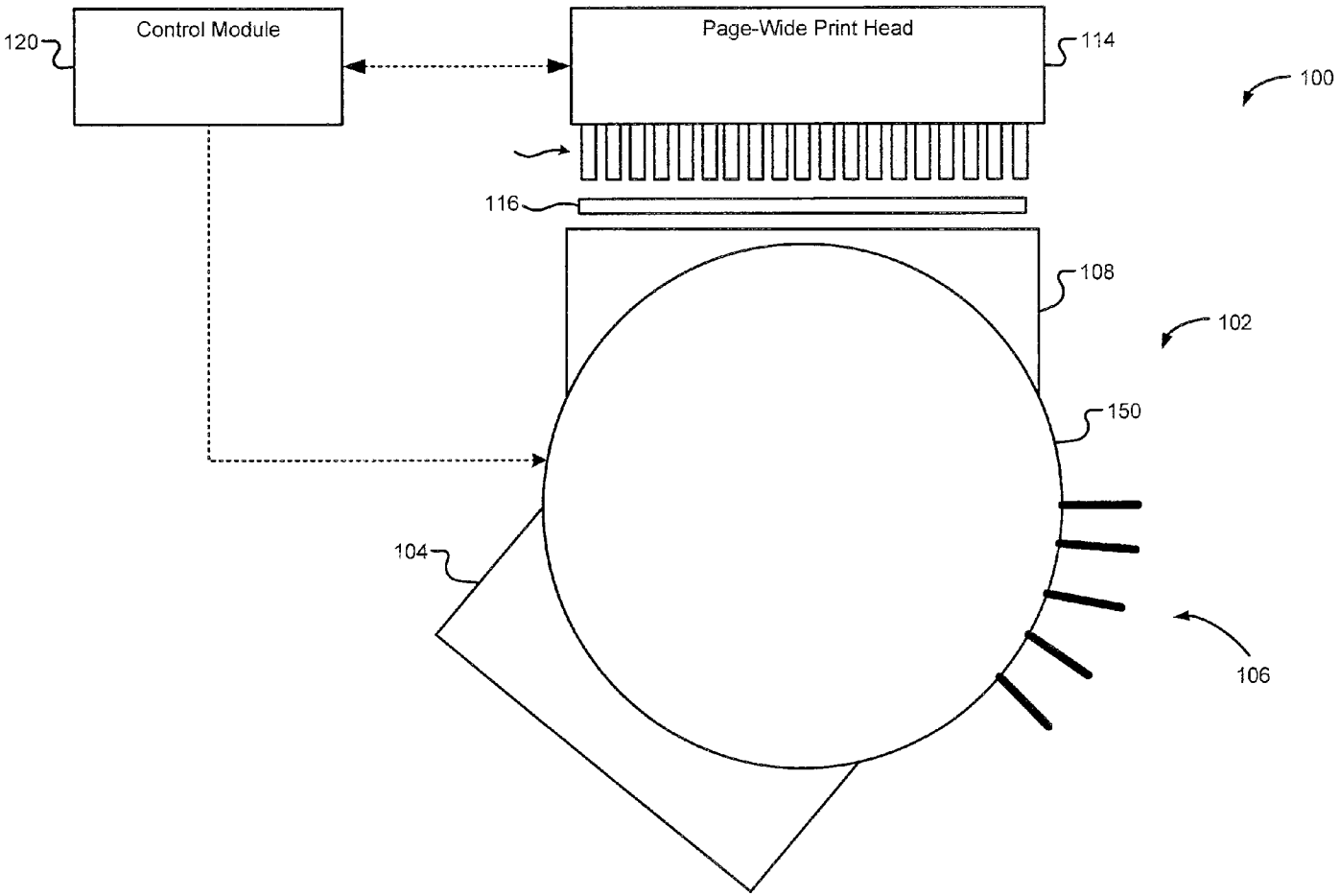
FIG. 3 is a functional block diagram of a second embodiment of the exemplary printing system according to the to the present disclosure.

Referring now to FIG. 3, a simplified side-view of a second embodiment of a printer system 100 in shown. In the present embodiment, the printer system 100 includes a rotating element 150 as a conveying mechanism for the assembly elements. Although the rotating element 150 is depicted as a "wheel", various other structures are contemplated.

Each respective servicing element is mounted on the rotating element 150. The rotating element 150 is operated in similar fashion as the drive belt 110. Specifically, movement of the rotating element 150 translates to movement of the assembly elements. In the present embodiment, a drive motor (not shown) rotates the rotating element 150 in either a clockwise or counter-clockwise direction and at a given rate. The control module 120 generates activation signals to control the rotational direction and the rate of rotation of the rotating element 150. Like the previous embodiment, the printer system 100 of the present embodiment further includes a position decoder (not shown) that determines a respective position of the rotating element 150 and transmits a position signal to the control module 120. The control module 120 selectively actuates the drive motor, thereby turning the rotating element 150 based on the position signal. As described above, the control module 120 activates the drive motor (i.e., rotates the rotating element 150) in order to substantially align the respective assembly elements relative to the print head 112. In this manner, each respective servicing function may be performed without requiring the print head 112 to move.

Figure 4:
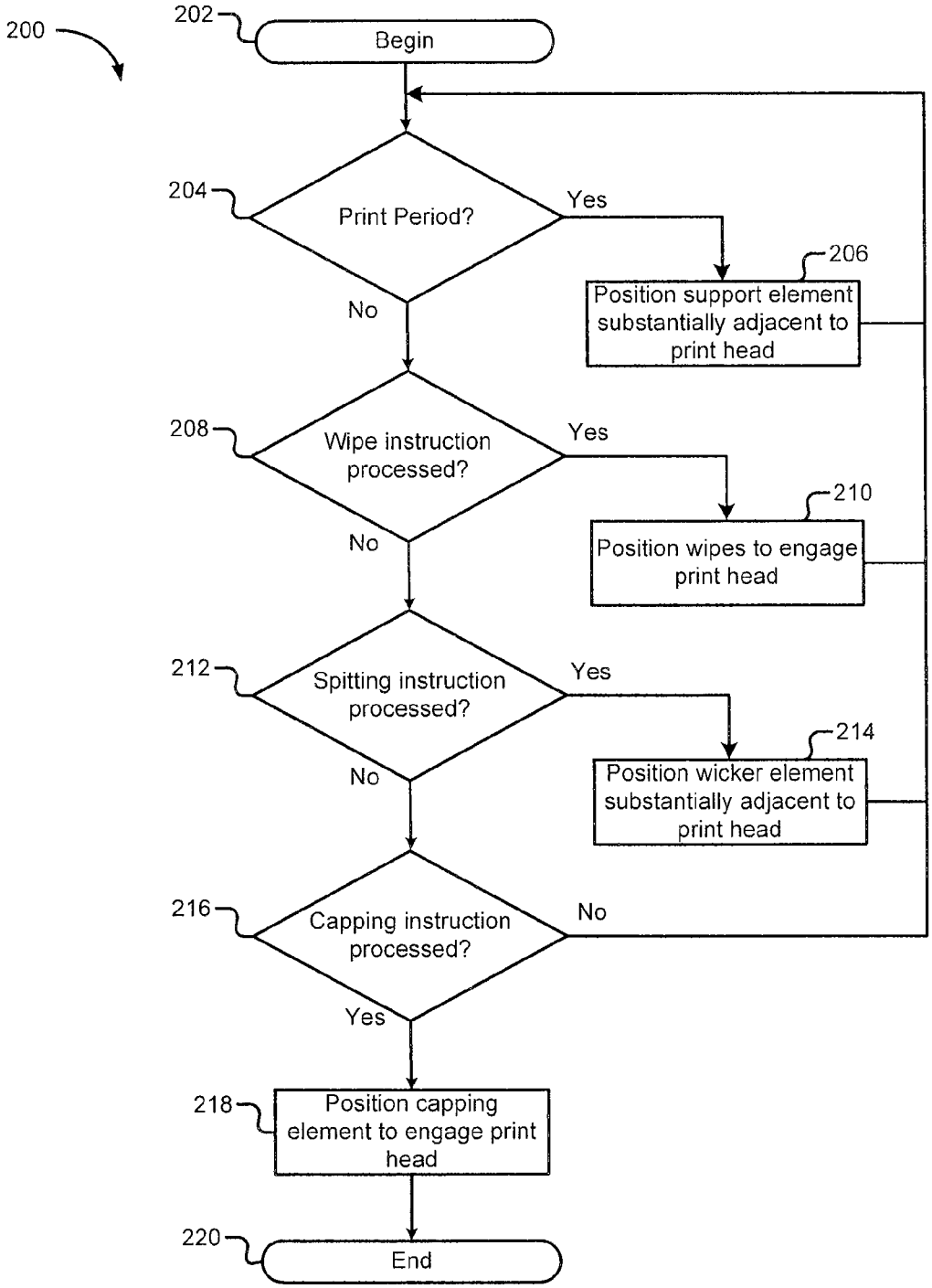
FIG. 4 is a flow diagram illustrating steps of operating the exemplary printing system according to the present disclosure.

Referring to FIG. 4, a method 200 illustrating the operation of the exemplary operational system of the printer system 100 is shown in more detail. The method 200 begins at step 202. In step 204, the control module 120 determines whether a print operation (i.e., a print period) has been initiated. If the control module 120 determines that a print operation has not been initiated, the method 200 proceeds to step 208. If the control module 120 determines that a print operation has been initiated, the method 200 proceeds to step 206. In step 206, the drive belt 110 is rotated to position the support element 108 substantially adjacent to the print head 112.

In step 208 the control module 120 determines whether a wipe instruction has been processed. If the control module 120 determines that a wipe instruction has not been processed, the method 200 proceeds to step 212. If the control module 120 determines that a wipe instruction has been processed, the method 200 proceeds to step 210. In step 210, the drive belt 110 is rotated to position the wipers 106 to engage the print head 104.

In step 212 the control module 120 determines whether a spitting instruction has been processed. If the control module 120 determines that a spitting instruction has not been processed, the method 200 proceeds to step 216. If the control module 120 determines that a spitting instruction has been processed, the method 200 proceeds to step 214. In step 214, the drive belt 110 is rotated to position the wicker element 118 to be substantially adjacent to the print head 104.

In step 216, the control module 120 determines whether a capping instruction has been processed. If the control module 120 determines that a capping instruction has not been processed, the method 200 returns to step 204. If the control module 120 determines that a capping instruction has been processed, the method 200 proceeds to step 218. In step 218, the drive belt 110 is rotated to position the capping element 104 to engage the print head 104. In step 220, the method 200 ends.

All of the discussion above, regardless of the particular implementation being described, is exemplary in nature, rather than limiting. Although specific components of the operational system are described, methods, systems, and articles of manufacture consistent with the operational system may include additional or different components. For example, components of the operational system may be implemented by one or more of: control logic, hardware, a microprocessor, microcontroller, application specific integrated circuit (ASIC), discrete logic, or a combination of circuits and/or logic. Further, although selected aspects, features, or components of the implementations are depicted as hardware or software, all or part of the systems and methods consistent with the operational system may be stored on, distributed across, or read from machine-readable media, for example, secondary storage devices such as hard disks, floppy disks, and CD-ROMs; a signal received from a network; or other forms of ROM or RAM either currently known or later developed. Any act or combination of acts may be stored as instructions in computer readable storage medium. Memories may be DRAM, SRAM, Flash or any other type of memory. Programs may be parts of a single program, separate programs, or distributed across several memories and processors.

The processing capability of the system may be distributed among multiple system components, such as among multiple processors and memories, optionally including multiple distributed processing systems. Parameters, databases, and other data structures may be separately stored and managed, may be incorporated into a single memory or database, may be logically and physically organized in many different ways, and may implemented in many ways, including data structures such as linked lists, hash tables, or implicit storage mechanisms. Programs and rule sets may be parts of a single program or rule set, separate programs or rule sets, or distributed across several memories and processors.

It is intended that the foregoing detailed description be understood as an illustration of selected forms that the invention can take and not as a definition of the invention. It is only the following claims, including all equivalents, that are intended to define the scope of this invention.

What is claimed is:

1. A printing system, comprising:

a print assembly, the print assembly configured to remain in a fixed position while printing on a print medium;

an operations assembly configured to execute one or more servicing functions on the print assembly during a non-print period at a servicing position along a path, wherein at least a part of the path is linear and the path at least partly encircles the print assembly; and a conveying mechanism operable to convey the operations assembly along the path;

wherein the operations assembly is configured to execute the one or more servicing functions on the print assembly by contacting or covering the print assembly;

wherein the operations assembly is also configured to provide support for the print medium in a printing direction during the print period.

2. The system of claim 1 wherein the conveying mechanism includes a drive belt.

3. The system of claim 1 wherein the conveying mechanism includes a rotating element.

4. The system of claim 1 wherein the print assembly comprises a page-wide inkjet print head.

5. The system of claim 1 wherein the conveying mechanism is operable to convey the operations assembly along the path in one of a first direction and a second direction, where the second direction is opposite of the first direction.

6. The system of claim 1 wherein the operations assembly includes a wiper, a capping element, and a support element.

7. The system of claim 6 wherein the wiper, the capping element and the support element are configured to be mounted on the conveying mechanism.

8. The system of claim 7 wherein the conveying mechanism is configured to position the capping element to engage the print assembly by covering the print assembly.

9. The system of claim 1 further comprising a driving element that rotates the conveying mechanism based on instructions from a control module.

10. The system of claim 9 wherein the control module stores the instructions in a memory or receives the instructions from an external source.

11. A method for operating a printing system, comprising:

operating a print assembly at a fixed position while printing on a print medium; and rotating an operations assembly along a path between a first position and a second position, wherein at least a part of the path is linear and the path at least partly encircles the print assembly;

executing, by the operations assembly, one or more servicing functions on the print assembly at the first position during a non-print period;

wherein the operations assembly executes the one or more servicing functions on the print assembly by contacting or covering the print assembly;

wherein the operations assembly also provides support for the print medium during the print period at the second position.

12. The method of claim 11 wherein conveying the operations assembly includes driving a belt.

13. The method of claim 11 wherein conveying the operations assembly includes rotating an element.

14. The method of claim 11 wherein the print assembly comprises a page-wide inkjet print head.

15. The method of claim 11 wherein conveying the operations assembly includes moving the operations assembly in one of a first direction and a second direction, where the second direction is opposite of the first direction.

16. The method of claim 11 wherein the operations assembly includes a wiper, a capping element, and a support element.

17. The method of claim 16 wherein the wiper, the capping element and the support element are mounted on a conveying mechanism.

18. A printing system, comprising:

a print assembly configured to remain in a fixed position while printing on a print medium;

an operations assembly configured to execute one or more servicing functions on the print assembly during a non-print period at a servicing position along a path, wherein at least a part of the path is linear and the path at least partly encircles the print assembly; and a conveying mechanism operable to convey an operations assembly along the path;

wherein the operations assembly is configured to execute the one or more servicing functions on the print assembly by contacting or covering the print assembly;

wherein the operations assembly is also configured to provide support for the print medium in a printing direction during the print period.

19. The system of claim 1 wherein the print assembly comprises a print head; and wherein the path is parallel along at least a part of the print head.

20. The system of claim 19, wherein the print head comprises a plurality of nozzles; and wherein the path is parallel along the plurality of nozzles of the print head.

21. The system of claim 1, wherein at least another part of the path is further convex with respect to the print assembly.

* * * * *